United States Patent [19]

Yamaguchi

[11] 4,095,402

[45] Jun. 20, 1978

[54] ROTARY RING FOR SPINNING

[76] Inventor: Hiroshi Yamaguchi, 12-go, 3-ban, 4-chome, Minamisakurazuka, Toyonaka-shi, Osaka-fu, Japan

[21] Appl. No.: 736,225

[22] Filed: Oct. 27, 1976

[30] Foreign Application Priority Data

Oct. 28, 1975 Japan ..... 50-130030

[51] Int. Cl.[2] ..... D01H 7/56

[52] U.S. Cl. ..... 57/124

[58] Field of Search ..... 57/121, 122, 124

[56] References Cited

U.S. PATENT DOCUMENTS

| | | | |
|---|---|---|---|
| 820,659 | 5/1906 | Metcalf | 57/124 |
| 3,481,131 | 12/1969 | Chelpan | 57/124 |
| 3,664,112 | 5/1972 | Netti et al. | 57/124 X |
| 3,981,135 | 9/1976 | Huber et al. | 57/124 |

*Primary Examiner*—Richard C. Queisser
*Assistant Examiner*—Charles Gorenstein
*Attorney, Agent, or Firm*—Hall & Houghton

[57] ABSTRACT

A rotary spinning ring construction is provided wherein the rotary ring body is provided with upper and lower outwardly tapered body portions, each of which has its surface provided with inclined grooves, a ring holder for receiving the rotary body therein, a sliding flange positioned between the holder and the body and having some play therein, and dust caps mounted on the upper and lower portions of the rotary body to seal the upper and lower areas of play between the holder and the rotary body. This arrangement results in a spinning ring construction that will dust automatically.

2 Claims, 3 Drawing Figures

ROTARY RING FOR SPINNING

BACKGROUND OF THE INVENTION (a) Field of the Invention

The present invention relates to a rotatable spinning ring of such construction that the ring will dust automatically.

(b) Description of the Invention

In rotatable spinning rings employed heretofore in which a passive rotary ring is rotated by the frictional pressure of a traveller or in which a rotary ring is rotated transitively by the means of a driven belt, a friction wheel, or the like, and notwithstanding the torque created by the rotation of the ring, together with the prolonged period of operation, dust problems, such as spinning-mill, minute floating fibers resulting from cut-off or fallen fuzz generated by squeezing yarn fibers at the point where snail wire, traveller, or the like, come into contact with the yarn, are created. Also, various fiber oil materials sticking to fibers which have fallen as minute powders as well as floating material found in the air around the spinning ring are created, so that the material is made into a felt-like admixture by being compressed in the play of the rotary body of the rotating, that is to say, between the rotary body and the holder on the opposite side which holds the rotary body or the bearing portion thereof, resulting in a similar dust problem. The dust problems so created tend to interrupt the rotary motion of the spinning ring.

According to the kind and fineness of the spinning fibers, such as, for example, synthetic fibers, card wool, flax, silk, cotton, and mixtures of the foregoing, such fiber dusts are generated in a large quantity. As a result thereof, the frictional resistance of the sliding position of the rotary ring was increased by such use after a period of only one to three months. Also, the rotation of the spinning ring did not function smoothly, and thus resulted in unequal tension between the spindles, and also the operation of the rotary ring was impaired due to an increase of the cutting of the yarn and deterring an increase of rotation thereof. A method for preventing this problem has been the construction of means for continuously blowing away the cotton dust or the like with air under pressure and the like. This operation is undesirable since a reconstruction of the machine base was required along with the positioning of the air compressor and the necessary piping in the area. From a standpoint of the required reconstruction of machine, the increase in cost resulting therefrom and the area needed for setting up the equipment and the use of the automatic doffer being interrupted, and from the viewpoint of the cost per one spindle and such meachanism, a practical use of such a system in a large area could not be achieved satisfactorily.

SUMMARY OF THE INVENTION

The present invention is directed to a solving of the foregoing problems, and to achieve a dusting action by having the ring rotary body commence its rotary motion by means of the frictional pressure of the traveller without requiring any power from an air compressor or any other external power source. The working force so created will be sufficient to blow away or exhaust short fibers and powders in a minute state at the first stage until cotton dusts and other powdery dusts are accumulated and placed into a felt-like admixture by being gathered together and compressed. This objective may be achieved by the rotary motion of an individual ring rotary body, and also the dusting effect may be obtained by the combined action of the physical action resulting from the periphery of the rotary body and the tapered construction of the inner surface of the holder, and the air flow generated by the inclined grooves cut in the periphery of the rotaty body.

In accordance with the present invention, air flow created by the rotation of the spinning ring is generated surely and strongly from the play between the rotary body and the holder toward the outside and by means of the tapered surface formed on the peripheral surface of the spinning ring body and the inclined grooves present on such surface and the inclined groove strips on the inner surface of the dust cover, the prevention of the intrusion of dust, and the exhausting of such dust are eliminated. The ring rotary body in carried on the holder such that a fine clearance is achieved during the rotation thereby insuring that the rotation thereof is smooth. Also, in accordance with the present invention, the spinning ring body is provided with a triangular annular sliding flange which is fitted in the central portion thereof and is associated with the traingular recessed groove of the holder, so that even under all rotary conditions, there will be no deviation of the axis of the rotary body, and thereby high speed rotation is possible. Also, the upper dust cover has the additional advantage of creating a brake action, stopping the ring rotary body.

The spinning ring body in accordance with the present invention is rotated passively by the tension of spinning yarn and the frictional pressure resulting from the sliding of the traveller. This action, as compared with a ring rotated positively by other power means, reflects sensitivity to all minute tension variations for every spindle due to the variation of the bobbin winding condition from the beginning of winding to the full winding thereof, the change of the outer diameter of caps and the diameter of the bottom between chases, the rise and fall of ring rail, the unequality of sliver, the unequality in grain and shape of travellers, the difference in the quantity of the abrasion of traveller, and minute manufacturing error of ring flange and the like. Thus, the difference of rotation of the rotary body or the spinning ring of each spindle performs a so-called speed change between chases, while a cutting or braking of yarn does not occur even if a momentary abnormal tension is applied, the tension being absorbed by rotating the ring at a high speed for a few seconds. Therefore, clogging by dust cottons, as before, and the variation of yarn tension due to the difference of rotary friction of the ring itself and the generation of fuzz and melted yarn is not caused. The high speed spinning effect of the rotary ring may be continued for a longer time period, if desired, and the effect of spinning of high quality yarn at a high degree of efficiency is demonstrated.

DESCRIPTION OF PREFERRED EMBODIMENT

Figure 1:
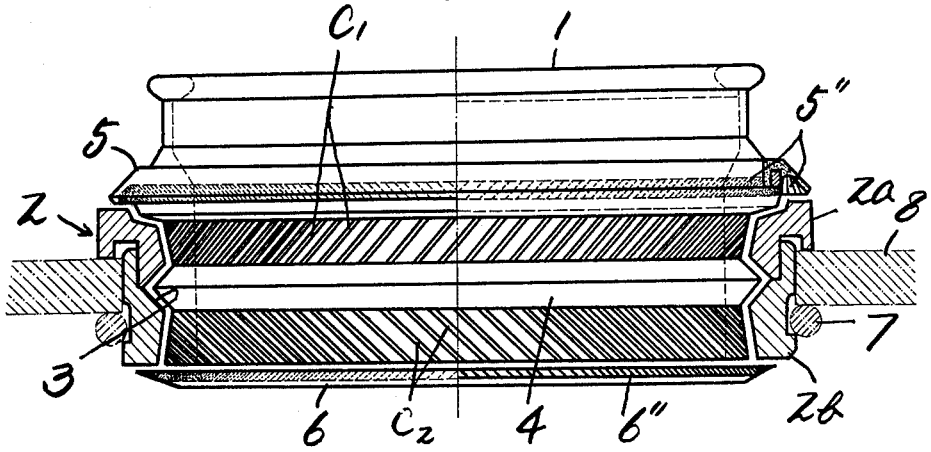
FIG. 1 is a front view partially longitudinally sectioned of a spinning ring assembly made in accordance with the present invention.
Figure 2:
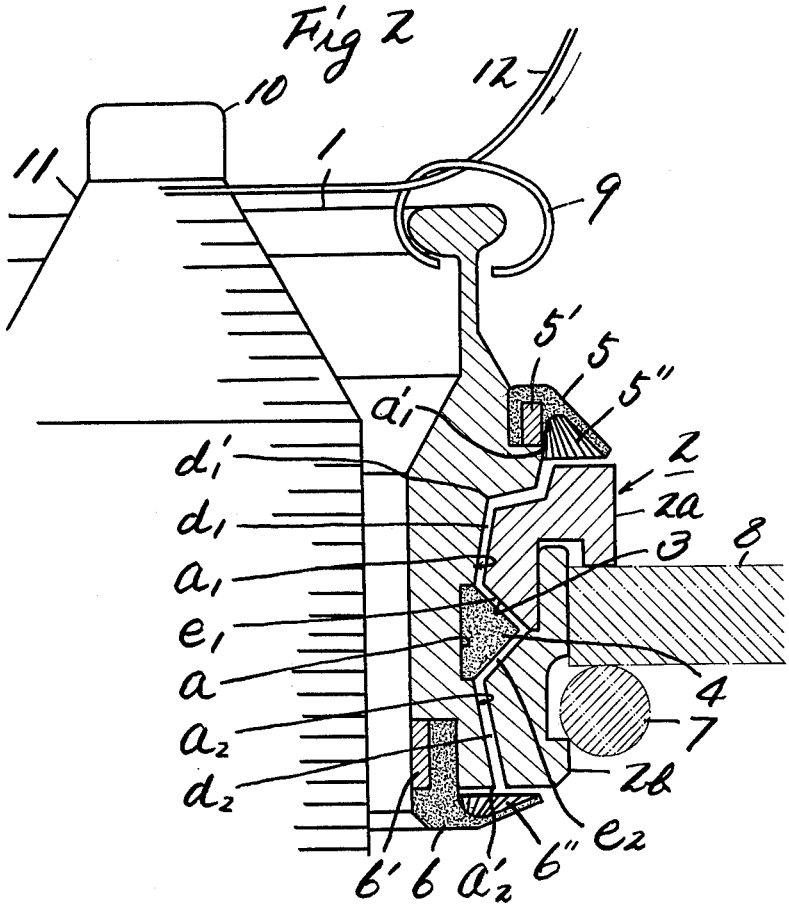
FIG. 2 is an enlarged longitudinal section of the main portion of a spinning ring assembly made in accordance with the present invention showing a state of operation at the time of normal running when the ring rotary body is being rotated freely.

As illustrated in FIGS. 1 and 2, the periphery of the spinning ring rotary body 1 is shaped so as to provide a tapered peripheral surface with increased diameter from the central portion *a* towards the upper and lower ends, respectively, with dust compressed interposedly being exhausted towards the upper and lower ends which are larger in outer diameter by the action of the centrifugal force created together with the rotation of the ring. The upper and lower tapered portions $a_1$ and $a_2$ of the periphery of the rotary body 1 are provided with a large number of inclined grooves $c_1$, $c_2$, respectively, for improving the efficiency of exhausing dust from the entire surface of the spinning ring body according to the respective direction of rotation of the ring from the central portion *a* of the body 1 to the respective ends $a_1$ and $a_2$. Thus, when the body 1 is in a state wherein there is no admixture such as cotton dust or the like present in the inclined grooves $c_1$ and $c_2$, there will be no friction resistance on the rotary body, as shown in FIG. 2. Thus, the rotation of the spinning ring is increased in speed and air flow exhausted towards the respective ends $a'_1$ and $a'_2$ of the upper and lower tapered portions $a_1$ and $a_2$ is generated and thereby preventing the intrusion of dust from the upper and lower ends. In this instance, when fine dust or the like should stick or enter, the admixture will be held in the small plays $d_1$ and $d_2$ between the ring rotary body 1 and the upper and lower bearings rings 2*a* and 2*b* forming the holder 2, and will be exhausted from the upper end $a'_1$ and the lower end $a'_2$ of the tapered portions $a_1$ and $a_2$ by the application of light friction. The dust discharged from both the upper and lower ends will be removed by air flow passing over the inclinded groove strips 5″ and 6″ cut in the inner walls of the upper dust cover 5 and the lower dust cover 6, and which is generated by the air flow passing outside by the rotation of the spinning ring. This action also simultaneously functions to exhaust dust cotton fine particles which may stick by reason of the physical centrifugal action to the outside area. The upper and lower dust covers 5 and 6 also carry out the action of a dust cover to prevent cotton dust from falling directly on the ring and from entering into the play of the ring rotary body. The holder 2 is fixed on the ring rail 8 by a stop ring 7, with a traveller 9, a bobbin 10, a bobbin yarn 11, and the spinning yarn 12 being included in the apparatus.

The upper and lower dust covers 5 and 6 are made from an aged elastic body, such as, for example, synthetic rubber and the like, and the core portion thereof fitted on the ring rotary body 1 has inserted therein metal rings 5′ and 6′ respectively. The dust covers 5 and 6 are pressed on the upper and lower peripheral edges of the rotary body 1 and are affixed thereto by means of the metal rings 5′ and 6′, and are thinner gradually towards the peripheral edge thereof. Therefore, since there will be almost no resistance due to the frictional pressure of the traveller against the torque in a state in which there is no engagement of the plays $d_1$ and $d_2$, and $e_1$ and $e_2$, and the like, the ring rotary body 1 will increase its speed gradually. When the rate of rotation goes above a specified value, such as, for example, with a 47 ring, 10 inch lift, 60's acrylic synthetic spinning yarn, the number of revolutions of the spindle will be 15,000 R/M. In the case of a traveller, the number of rotations of the ring will be 5,000 R/M. The edges of the dust covers 5 and 6 will be opened slightly due to centrifugal force, and will generate a violent circulating air flow so that cotton dust around the ring will be blown away and cannot enter into the ring. Therefore, the rate of rotation of the spinning ring may be increased to 90%–95% of that of the spindle depending on the twisting factor of the spinning yarn. The dust covers 5 and 6 also function as a brake thereby preventing the spinning ring from continuously rotating inertially after the stopping of the spindle by the shutting off of the power.

Figure 3:
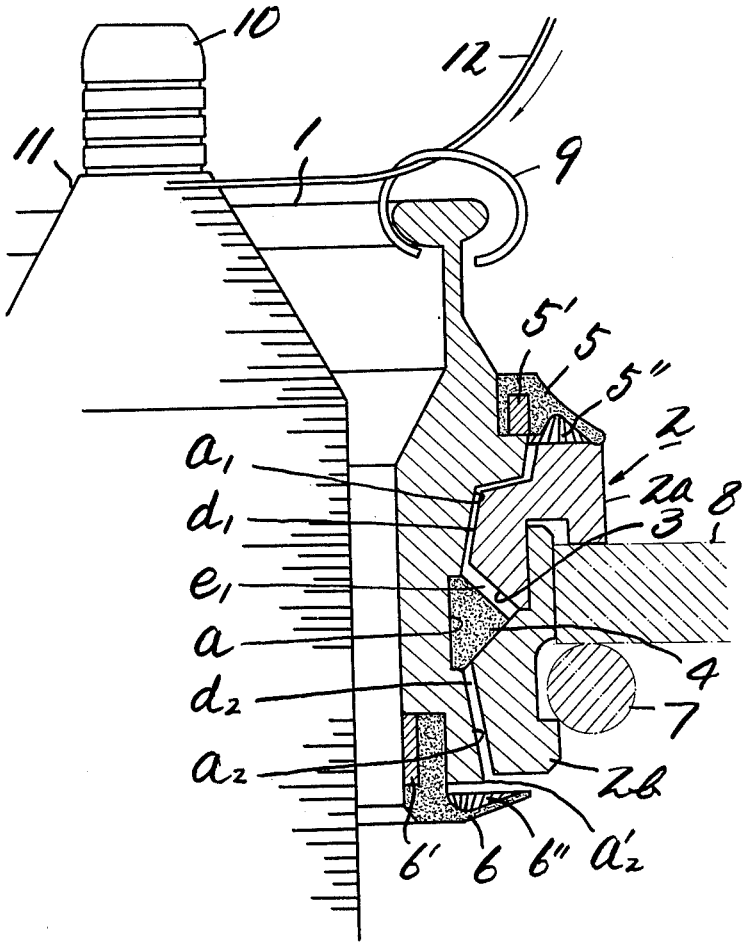
FIG. 3 is an enlarged longitudinal section of the main portion of a spinning ring assembly made in accordance with the present invention and showing a state of operation in which the ring rail is located in the upper position and the tension of the upper spinning yarn is decreased and the ring rotary body is associated with the holder and is borne thereby.

When the rotation of the spinning ring is lowered and the tension of the spinning yarn is reduced due to the reduction of the frictional pressure of the traveller rotating the ring, the upper vector of the apparatus having the ring rotary body 1 upwards in the inner diameter at the intermediate position of the plays $e_1$ and $e_2$ at the bearing portion of the triangular groove of the upper and lower bearing rings 2*a* and 2*b* is reduced and the ring rotary body 1 is lowered, as shown in FIG. 3. The triangular annular sliding flange 4 is positioned against the conical surface of the triangular groove of the lower bearing ring 2*b*, while the periphery of the edge of the upper dust cover 5 is lowered and contacted against the upper surface of the upper bearing ring 2*a* and imposes a quick resistance upon the rotation of the ring, and thereby achieves the action of stopping the rotation of the ring before the stop of the rotation of the spindle. By this action, the generation of snarl due to the inertial rotation of the ring may be prevented. The plays $e_1$ and $e_2$ at the bearing portions are smaller than the plays $d_1$ and $d_2$ at the tapered inclined groove and even when the plays $e_1$ and $e_2$ are eliminted by a contacting, the plays $d_1$ and $d_2$ maintain small plays of some degree and will not interrupt the dusting function of the apparatus.

The triangular annular sliding flange 4 formed by fitting same in the recessed groove at the central portion on the periphery of the ring rotary body 1 is made of an abrasive resistant material having a non-lubricating low frictional factor, such as, for example, tetrafluoroethylene resin or the like containing a filling material. This annular sliding flange 4 is positioned at the triangular surface thereof to the inside of the smooth recessed triangular groove 3 of the holder 2 formed from the upper and lower bearing rings 2*a* and 2*b*, with very small plays $e_1$ and $e_2$ created between them and thereby forming a concave-convex triangular bearing portion in cross section therebetween. When the rotation of the spindle is low, i.e., the tension of the upper spinning yarn S and the weight of the ring rotary body 1, the ring rotary body 1 is lowered and positioned agannst the lower bearing ring 2*b*, and is rotated slowly. When the spindle is rotated at a high rotational speed or the tension of the spinning yarn is increased, i.e., by the tension of the upper spinning yarn S and the weight of the ring rotary body 1, the ring rotary body 1 is lifted upwards and comes into contact alternately against both the upper and lower bearing rings 2*a* and 2*b* at the bearing portion, or separated from both of them and frictional resistance is greatly reduced and a state is brought about wherein the frictional resistance between the traveller and the ring is greater than the frictional resistance at the plays $e_1$ and $e_2$, and thereby the ring is rotated at a high speed, this being the state shown in FIG. 2. This causes such action that if the ring is rotated at a high speed when the tension of spinning yarn is small, and the ring is lowered and contacted against the lower bearing ring 2b, and friction between the traveller and the ring is reduced further, and thereby balloon collapse is increased or the generation of snarl is brought about, so that at this time point, the edge portion of the upper dust cover 5 is contacted against the upper surface of the upper bearing ring 2a of the holder and controls the overrun of the ring. When the tension of spinning yarn is increased and the ring rotary body 1 is lifted, the edge of the upper dust cover 5 is separated from the upper surface of the upper bearing ring 2a and is discontacted therefrom. When a strong torque due to the frictional pressure of the traveller acts on the ring flange the ring rotary body 1 is rotated at a high speed and air flow layer is generated in the plays $e_1$ and $e_2$ and it acts as a kind of air bearing and floats the ring rotary body 1 in the air. The ring rotary body 1 may be moved up and down by the small clearance of the plays $e_1$ and $e_2$ according to the variation of the tension of the spinning yarn, but as the bearing surfaces of the upper and lower bearing rings 2a and 2b receiving this and the contacting surfaces of the sliding flange 4 have a taper of the same angle, the center of the ring rotary portion is not biased with respect to the center of the holder portion, so that the ring can be rotated smoothly and at a high speed. In an actual spinning test in accordance with the present invention, stability was achieved completely with the ring at 17,000 R/M when the spindle is at 18,000 R/M.

What is claimed is:

1. A rotary spinning ring construction comprising a rotary ring body having an upper tapered portion and a lower tapered portion, each of said upper and lower tapered portions tapering outwardly gradually from a central portion of said rotary ring body to respective upper and lower end portions of said ring body, inclined grooves positioned in said upper and lower tapered portions of said ring body, a holder for receiving said ring body in rotatable relationship therein, said holder having an annular triangular groove in the central portion of the inner surface thereof, a triangular annular sliding flange mounted around the central portion of said ring body and positioned in said triangular groove on the inner surface of said holder to thereby rotatably support said ring body in said holder with a small amount of play therebetween, and an elastic dust cover fitted around each of the upper and lower end portions respectively of the rotary ring body to cover respectively the openings of the upper and lower areas of play between the ring body and the holder, each of said dust covers having a large number of inclined grooves on the inner surface thereof.

2. A rotary spinning ring construction in accordance with claim 1, wherein said holder comprises an upper bearing ring and a lower bearing ring fitted within one another.

* * * * *